United States Patent [19]

Mazo et al.

[11] Patent Number: 4,496,011

[45] Date of Patent: Jan. 29, 1985

[54] TOOL FOR FORMING EARTH HOLES HAVING FIXED WALLS AND METHOD THEREFOR

[75] Inventors: Boris M. Mazo; Valentin I. Feklin, both of Dnepropetrovsk, U.S.S.R.

[73] Assignee: Dnepropetrovsky Inzhenerno-Stroitelny Institut, Dnepropetrovsk, U.S.S.R.

[21] Appl. No.: 402,073

[22] Filed: Jul. 26, 1982

[30] Foreign Application Priority Data

Sep. 22, 1981 [SU] U.S.S.R. ..... 3330152
Sep. 22, 1981 [SU] U.S.S.R. ..... 3330153

[51] Int. Cl.[3] ..... E21B 7/26

[52] U.S. Cl. ..... 175/19; 175/388; 175/394; 405/236; 405/240

[58] Field of Search ..... 175/19, 21, 22, 23, 175/24, 388, 394, 323, 72, 171; 405/236, 240, 241, 242

[56] References Cited

U.S. PATENT DOCUMENTS

| | | | |
|---|---|---|---|
| 968,471 | 8/1910 | Hardsocg | 175/388 |
| 1,993,365 | 3/1935 | Englebright et al. | 175/394 |
| 2,229,912 | 1/1941 | Baily . | |
| 2,578,996 | 12/1951 | Endersby . | |
| 2,603,319 | 7/1952 | Dyche | 175/394 |
| 2,729,067 | 1/1956 | Patterson | 175/388 |
| 3,391,544 | 7/1968 | Daczko | 175/19 |
| 3,690,109 | 9/1972 | Turzillo . | |
| 4,135,588 | 1/1979 | Wagner | 175/19 |
| 4,193,461 | 3/1980 | Lamberton et al. . | |

FOREIGN PATENT DOCUMENTS

| | | |
|---|---|---|
| 54095 | 3/1912 | Fed. Rep. of Germany . |
| 3006224 | 8/1981 | Fed. Rep. of Germany . |
| 1322130 | 2/1963 | France . |
| 2215075 | 8/1974 | France . |
| 1162014 | 8/1969 | United Kingdom . |

*Primary Examiner*—James A. Leppink
*Assistant Examiner*—Mark J. DelSignore
*Attorney, Agent, or Firm*—Fleit, Jacobson, Cohn & Price

[57] ABSTRACT

A tool comprises two coaxial casings, a leading and a trailing ones, connected by a tubular element provided with ports for discharging a fixing material into a hole. The leading casing comprises a cylindrical portion, and frontal and rear conical tips provided with spiral tapered surfaces intended for consolidating soil. The trailing casing has a cylindrical portion of a greater diameter than that of the cylindrical portion of the leading casing. In the trailing casing there is provided an axial duct communicating with a cavity of the coupling element for supplying a fixing material. A method of forming holes having fixed walls includes formation of a pilot hole using the leading casing, and subsequent formation of a hole of a predetermined diameter using the trailing casing in the advancing sinking of a pilot hole. After the well has been sunk to a full depth, the tool is lifted until it leaves the pilot hole, the fixing material is fed into the pilot hole, and the secondary sinking of the hole is accomplished, while pressing the fixing material into walls and a bottom of the hole.

4 Claims, 6 Drawing Figures

TOOL FOR FORMING EARTH HOLES HAVING FIXED WALLS AND METHOD THEREFOR

BACKGROUND OF THE INVENTION

1. Field of the Invention

The present invention relates to construction technology, and in particular to a method and apparatus for forming earth holes, having fixed walls, in various non-rock soils, and preferably in weak and water-saturated soils.

2. Description of the Prior Art

Known in the art is a tool for forming earth holes, disclosed in the earlier application by V. I. Feklin et al., and comprising a leading casing having a cylindrical sizing portion, and a frontal and rear conical tips provided with spiral tapered surfaces for consolidating soil, and a trailing casing disposed above said leading casing and in coaxial relationship therewith, the trailing casing having a configuration similar to that of the leading one. The leading and trailing casings are connected therebetween by a tubular coupling element provided with a cavity communicating with a duct provided within the trailing casing, and with openings made in the walls.

Such an arrangement allows the fixation of the hole walls to be carried out with various fixing materials in the course of tool intrusion into soil. However, in so doing, the bottom and walls of the hole at the lower portion thereof are left unfixed, which fact in the course of deeping the hole below the level of subsoil waters can result in inundation of the hole and in embarassment of subsequent erection of piles. In the use of such a tool for the fixation of the hole bottom, it is necessary to withdraw the tool to the surface, to supply the fixing material into the hole through the collar thereof, and to accomplish secondary sinking of the whole hole. This results in a substantial increase in the labor consumption of the process and in a decrease in the work quality, since the hole walls at a lower portion thereof drift prior to the fixation process in the course of secondary sinking, the hole becomes filled with water filtering through the unfixed bottom.

In the above-mentioned application there is described a method of making a hole having fixed walls, comprising forming a hole without soil excavation, supplying a fixing material into the hole, and fixing hole walls by pressing the fixing material into the hole walls simultaneously with the hole formation.

Such a method ensures an increase in the stability of the hole walls and a decrease in the labor consumption in the course of the hole formation.

However, in the penetration of the hole bottom down to a level lying below the horizon of subsoil waters, the efficiency of the given method is decreased since in the use thereof is not achieved the fixation of the hole bottom and of the lower portion thereof, thereby resulting in the filtration of water into the hole and in the drift of its walls at the lower portion.

The invention is based on the problem to provide a tool and a method of forming earth holes having fixed walls, which allow the efficiency and reliability of the fixation of walls and a bottom of the hole to be increased.

SUMMARY OF THE INVENTION

The object of the invention is an increase in the efficiency and reliability of the fixation of a hole in weak and water-saturated soils by providing a novel tool and a method of forming holes having fixed walls.

The object set forth is attained by that in a tool for forming holes having fixed walls a trailing casing is provided with a sizing portion whose diameter is greater than that of a leading casing. With such an arrangement the directions of coiling spiral surfaces of tips of both the casings coincide. A coupling element connecting both the casings is provided with blades disposed along a spiral relative to the axis thereof, the direction of coiling said spiral being opposite to the direction of coiling a spiral surface of the frontal tip of the tool leading casing.

The object set forth is further attained by that in a method of forming holes having fixed walls at first a pilot hole is formed, whose diameter is smaller than that of the required hole, and whose depth is determined by the length of a leading portion of the tool, following which the sinking of the main hole is accomplished together with the advancing sinking of the pilot hole and with the supply of a fixing material into the pilot hole at the portions to be fixed, and after the sinking is over, the borehole tool is lifted to a height which is not less than the length of the leading portion thereof, and the fixing material is fed into the hole, following which the secondary sinking of the lower portion of the hole is carried out while fixing walls and bottom thereof.

BRIEF DESCRIPTION OF DRAWINGS

The invention is further explained by the drawings, in which:

FIG. 7 shows a general view of the tool for forming holes provided with a rear conical packer.

DESCRIPTION OF PREFERRED EMBODIMENT

Figure 1:
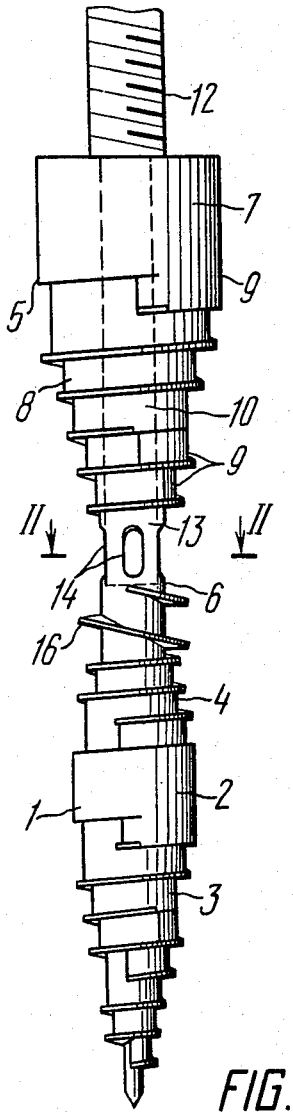
FIG. 1 shows a perspective view of the tool for forming holes.
Figure 2:
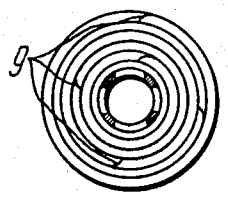
FIG. 2 shows a view 2—2 of FIG. 1.
Figure 3:
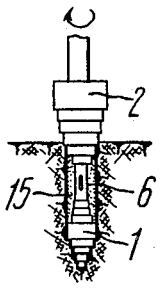
FIG. 3 shows an initial step of well sinking.
Figure 4:
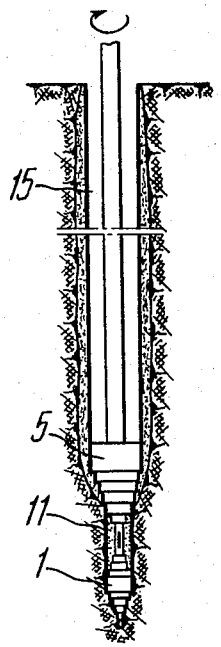
FIG. 4 shows the process of hole sinking with simultaneous fixation of walls thereof.
Figure 5:
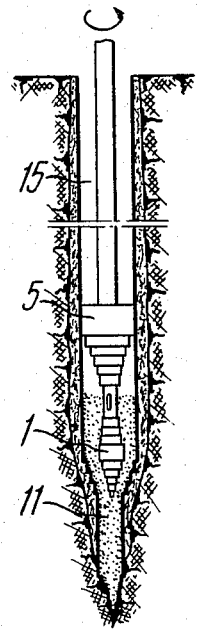
FIG. 5 shows the supply of a fixing material to the hole bottom.

A tool for forming earth holes having fixed walls includes a leading casing 1 (FIG. 1) comprising a cylindrical sizing portion 2, a frontal 3 and a rear 4 conically shaped tips provided with spiral tapered surfaces for consolidating soil, said surfaces having the same direction of coiling, and a trailing casing 5 disposed above the leading casing 1 and connected therewith by means of a tubular element 6, the leading casing 1, the trailing casing 5 and the tubular element 6 having a common longitudinal axis, and the trailing casing 5 comprises a cylindrical portion 7 having a greater diameter than that of the cylindrical portion 2, and equal to the diameter of the main borehole, and a frontal reamer 8 of a conical shape, disposed coaxially with the cylindrical portion 7 and provided with a spiral tape surface whose coiling direction coincides with that of the spiral surfaces of the frontal 3 and the rear 4 tips of the leading casing 1, said spiral tapered surface being made in the form of coaxially disposed cylindrical portions whose radii decrease stepwise downwards in the direction from the sizing portion 7 of the trailing casing 5 to the location of the connection between the casing 5 and the tubular element 6, the cylindrical surfaces of the coaxial portions, constituting the tip 8 of the trailing casing 5, being smoothly conjugated therebetween by adapted portions (FIG. 2). The trailing casing 5 of the tool is provided with a duct 10 (FIG. 1) for supplying a fixing material 11, communicating with a cavity of a bore rod 12, and the element tubular 6 has a cavity 13 communicating with the duct 10, ports 14 within the walls for discharging the fixing material 11 into a hole 15 (FIGS. 3, 4, 5), and blades 16 disposed relative to the tubular element 6 along a spiral whose coiling direction is opposite to that of the spiral surfaces of the tips 3, 4 of the leading casing 1 and the reamer 8 of the trailing casing 5 of the tool.

Figure 6:
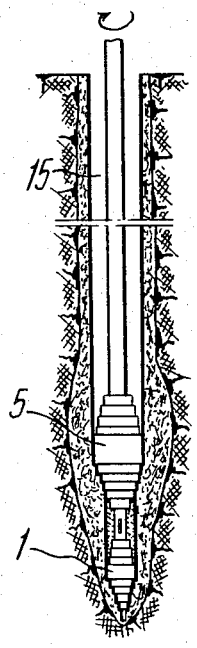
FIG. 6 shows the fixation of walls of the hole lower portion and of the bottom thereof.

The method is carried out as described below in the description of tool operation. In the course of rotation which is transmitted to the tool from a drive (not shown) the leading casing 1 of the tool, due to the provision of the frontal conically shaped tip 3 is screwed into soil, thereby forming the hole 15 (FIG. 3) which hole, in the course of intrusion of the trailing casing 5 thereinto, expands to a predetermined diameter (FIG. 4) which is equal to that of the cylindrical portion 7 of the trailing casing 5. The cylindrical portion 7 accomplishes the function of sizing the hole 15. As the tool is penetrating into the soil, the latter is pressed into the walls of the hole 15 by the surfaces of adapting portions 9 of the conical reamer 8 of the trailing casing 5. In the course of sinking those portions of the hole 15 where soil is to be fixed, the fixing material 11 is fed through the cavity of the bore rod 12, the duct 10 provided inside the driven casing 5, and the cavity 13 provided within the tubular element 6, which are serially communicating with one another, said fixing material being supplied through the ports 14 provided within the walls of the tubular element 6 and into the space between the leading casing 1 and the trailing casing 5 and, as the tool penetrates into the soil, is pressed into the walls of the hole 15, thereby fixing same. The provision of the blades 16 disposed on the surface of the tubular element 6 along a spiral relative said element, the coiling direction of said spiral being opposite to that of the spiral surfaces of the tips of the leading casing 1 and the reamer 8 of the trailing casing 5, makes it possible to mix the fixing material 11, due to which fact its consistency is maintained the same throughout the whole volume thereof, thereby promoting an increase in the efficiency of the fixation of the walls of the hole 15, and ensures the equal strength. Moreover, the blades 16 prevent from sticking soil to the surface of the tubular element 6 and penetration of developed soil from the hole 15 into the cavity 13 through the ports 14. After the sinking of the hole is over, the tool is unscrewed (FIG. 5) by changing the direction of its rotation, the fixing material 11 disposed within the space between the leading casing 1 and the trailing casing 5 being pressed into the walls of the hole by the rear conical tip 4 and the cylindrical portion 2 of the leading casing 1. The device is lifted to the height which is not less than the length of the leading portion thereof, i.e. the distance from the lowermost point of the casing 1 to the lowermost point of the trailing casing 5, or until the tool leaves the pilot hole, while continuing the supply of the fixing material 11 which drops down to the bottom of the hole 15, and after the lower portion or the pilot hole in the primary well 15 is filled with the fixing material 11, the secondary sinking of the lower portion of the hole is accomplished (FIG. 6). In so doing, the fixation of the hole bottom and of the walls of the lower portion thereof is achieved.

Also possible is such a modification of the above described device wherein the trailing casing is provided with a rear packer 17 whose shape is similar to that of the rear tip of the leading casing (FIG. 7). In this case it is possible to accomplish the fixation of the hole walls in two layers during one sinking operation, the second layer of the fixing material supplied directly into the hole prior to the withdrawal of the tool being pressed into the hole walls by the surface of the rear conical packer 17 of the driven casing in the course of unscrewing the tool from the hole.

The coiling direction of the spiral surfaces of the rear tip 4 of the leading casing 1 and the rear packer 17 of the trailing casing 5 can be opposite to that of the spiral surfaces of the frontal tip 3 of the leading casing 1 and the frontal reamer 8 of the trailing casing 5. In this case the withdrawal of the tool out of the hole is carried out by changing the direction of the tool feeding (from below upwardly), but without the change in the direction of tool rotation.

The use of the tool of the invention allows the fixed holes to be formed within weak and water-saturated soils wherein the horizon of subsoil waters lies above the hole bottom. The filtration of water into the hole is prevented. When using the hole for filling piles, due to additional consolidation of soil at the hole bottom, the carrying capacity of a pile is increased by 15% to 30%.

What is claimed is:

1. A tool for forming earth holes having fixed walls, said tool comprising:

a leading casing provided with a cylindrical portion and frontal and rear conical tips, said frontal and rear conical tips being provided with spiral tapered surfaces for consolidating soil and said frontal and rear conical tips each being disposed on one side of said cylindrical portion;

a trailing casing disposed above said leading casing coaxially with the leading casing and said trailing casing being provided with a cylindrical portion whose diameter is greater than that of said cylindrical portion of said leading case, the diameter of the cylindrical portion of said trailing casing corresponding to the diameter of the hole being formed;

a frontal conical reamer positioned below the cylindrical portion of said trailing casing and said frontal conical reamer provided with spiral tapered surfaces for consolidating soil;

an axial duct defined by the trailing casing; and a tubular element connecting said leading and trailing casings, said tubular element communicating with the axial duct in said trailing casing and said tubular element being provided with ports.

2. A tool as claimed in claim 1, wherein the trailing casing is provided with a rear conical packer having spiral tapered surfaces for consolidating soil.

3. A method of forming earth holes having fixed walls, said method comprising the steps of:

(a) forming a pilot hole whose diameter is smaller than a predetermined diameter, using a tool comprising a leading casing with a cylindrical sizing portion, a trailing casing disposed above said leading casing, and a tubular element connecting said leading and trailing casings, communicating with an axial duct in said trailing casing, and provided with a port for discharging fixing materials into the hole;

(b) forming a hole of the predetermined diameter with said tool with advance of the step (a);

(c) feeding the fixing material into the pilot hole at the regions thereof to be fixed;

(d) lifting the tool after forming the hole of the predetermined diameter until the tool leaves the pilot hole;

(e) feeding the fixing material into the hole following the step (d), and then (f) repeated sinking of the hole, whereby the fixing material is pressed into the walls and the bottom of the hole; and (g) withdrawing the tool from the finished hole.

4. A method as claimed in claim 3, wherein the repeated sinking of the hole is accomplished by a tool comprising a leading casing with a cylindrical portion, a trailing casing disposed above said leading casing, said trailing casing further comprising a rear conical tip having spiral tapered surfaces, and a tubular element connecting said leading and trailing casings, communicating with an axial duct in said trailing casing, and provided with a port for discharging fixing materials, and, prior to carrying out the step (g), the fixing material is supplied into the hole, following which said tool is withdrawn, while pressing one more layer of the fixing material into the hole walls by means of the rear conical tip of the trailing casing.

* * * * *